US012584429B2

(12) United States Patent
Zitarosa et al.

(10) Patent No.: US 12,584,429 B2
(45) Date of Patent: Mar. 24, 2026

(54) ENGINE CRANKCASE VENTILATION SYSTEM

(71) Applicant: Grimaldi Development AB, Nacka Strand (SE)

(72) Inventors: Francesco Zitarosa, Illertissen (DE); Christoph Erdmann, Ulm (DE); Claes Inge, Nacka (SE); Peter Franzén, Bandhagen (SE); Carl Petrus Häggmark, Täby (SE); Dan Öivind Karlsson, Grödinge (SE)

(73) Assignee: Grimaldi Development AB, Nacka Strand (SE)

( * ) Notice: Subject to any disclaimer, the term of this patent is extended or adjusted under 35 U.S.C. 154(b) by 0 days.

(21) Appl. No.: 18/724,903

(22) PCT Filed: Feb. 16, 2023

(86) PCT No.: PCT/EP2023/053837

§ 371 (c)(1),
(2) Date: Jun. 27, 2024

(87) PCT Pub. No.: WO2023/161106

PCT Pub. Date: Aug. 31, 2023

(65) Prior Publication Data

US 2024/0418110 A1 Dec. 19, 2024

(30) Foreign Application Priority Data

Feb. 25, 2022 (SE) ..... 2250255-3

(51) Int. Cl.
*F01M 13/04* (2006.01)

(52) U.S. Cl.
CPC ..... *F01M 13/04* (2013.01); *F01M 2013/0422* (2013.01); *F01M 2013/0438* (2013.01)

(58) Field of Classification Search
CPC ..... F01M 13/04; F01M 2013/0422; F01M 2013/0438
See application file for complete search history.

(56) References Cited

U.S. PATENT DOCUMENTS 2,867,285 A * 1/1959 Wintermute ..... B03C 3/15 96/61
6,058,917 A * 5/2000 Knowles ..... F02D 11/02 123/573

(Continued)

FOREIGN PATENT DOCUMENTS

CN 1961139 A 5/2007
CN 104540570 A * 4/2015 ..... B01D 45/08

(Continued)

OTHER PUBLICATIONS

International Search Report and Written Opinion mailed May 4, 2023, issued in corresponding International Patent Application No. PCT/EP2023/053837, 8 pages.

(Continued)

*Primary Examiner* — Kurt Philip Liethen
(74) *Attorney, Agent, or Firm* — Christensen O'Connor Johnson Kindness PLLC

(57) ABSTRACT

A crankcase ventilation system (1) is provided. The system comprises a housing (10), a disc stack separator (20) arranged within the housing which comprises a chamber (21), and a rotor (22). The rotor comprises an oil separating element (23) arranged within the chamber and spaced from one or more walls of the chamber, a shaft (24) configured to rotatably mount the oil separating element. The disc stack separator further comprises a first gas inlet (41) and a first gas outlet (42). The system further comprises a filter element (30) comprising a second gas inlet (43), a second gas outlet (44), and a filter (31) arranged between the second gas inlet and the second gas outlet. The first gas inlet is configured to (Continued)

be connected to a crankcase blow-by outlet of the ICE, and the first gas outlet is connected to the second gas inlet.

15 Claims, 5 Drawing Sheets

(56) References Cited

U.S. PATENT DOCUMENTS

| | | | | |
|---|---|---|---|---|
| 6,090,184 | A * | 7/2000 | Cartellone | B01D 53/0407 15/353 |
| 6,530,969 | B2 * | 3/2003 | Gieseke | B01D 46/62 55/482 |
| 6,647,973 | B1 | 11/2003 | Schueler et al. | |
| 7,235,177 | B2 | 6/2007 | Herman et al. | |
| 7,704,300 | B2 * | 4/2010 | Szepessy | B01D 45/14 96/57 |
| 8,485,145 | B2 | 7/2013 | Palumbo | |

FOREIGN PATENT DOCUMENTS

| | | | |
|---|---|---|---|
| CN | 111 203 036 | A | 5/2020 |
| CN | 111 997 713 | A | 11/2020 |
| CN | 113 464 242 | A | 10/2021 |
| EP | 0 353 903 | A1 | 2/1990 |
| EP | 3 266 524 | A1 | 1/2018 |
| JP | 2002-106320 | A | 4/2002 |
| JP | 2002-266621 | A | 9/2002 |
| JP | 2005-530096 | A | 10/2005 |
| JP | 2008-501505 | A | 1/2008 |
| JP | 2017-515671 | A | 6/2017 |
| WO | 2004/001200 | A1 | 12/2003 |
| WO | 2005/119020 | A1 | 12/2005 |

OTHER PUBLICATIONS

International Preliminary Report on Patentability mailed May 13, 2024, issued in corresponding International Patent Application No. PCT/EP2023/053837, 12 pages.

First Office Action mailed Feb. 21, 2025, issued in corresponding Chinese Application No. 202380017665.0, filed Feb. 16, 2023, 12 pages.

* cited by examiner

ENGINE CRANKCASE VENTILATION SYSTEM

FIELD OF THE INVENTION

The present invention is generally related to crankcase ventilation systems, and more specifically to automotive crankcase ventilation systems.

BACKGROUND OF THE INVENTION

It has been an interest in reducing emissions produced by internal combustion engines, ICEs, for decades. Reductions have been achieved in various ways, such as by using catalytic converters and improving the efficiency of ICEs to reduce the consumption of fuel. However, such reductions mainly target exhaust gases that would be discharged through an exhaust pipe of the ICE. Thus, there has been an increased interest in reducing the emissions of other exhaust gases, such as crankcase blow-by gases. Additionally, vehicle emission standards are starting to include standards for all vehicle emissions, thereby including emissions from crankcase blow-by gases, which further increases the interest in reducing such emissions.

SUMMARY OF THE INVENTION

It is of interest to provide a crankcase ventilation system for separating oil particles from crankcase blow-by gases of an internal combustion engine which may reduce crankcase blow-by gas emissions. It is a further interest to provide an improved quality, i.e. less oil particles, of crankcase blow-by gas which is released to the atmosphere, or sent back to a combustion chamber of an ICE. These interests are met by providing an arrangement having the features in the independent claims. Preferred embodiments are defined in the dependent claims.

Hence, according to an aspect of the present disclosure, there is provided a crankcase ventilation system for separating oil particles from crankcase blow-by gases of an internal combustion engine, ICE. The system comprises a housing and a disc stack separator. The disc stack separator may be arranged within the housing. The disc stack separator comprises a chamber and a rotor. The chamber may be arranged within the disc stack separator. The rotor comprises an oil separating element arranged within the chamber and spaced from one or more walls of the chamber, and a shaft configured to rotatably mount the oil separating element. The oil separating element may comprise a plurality of stacked plates, wherein the plates may be conical. The disc stack separator further comprises a first gas inlet for supplying the crankcase blow-by gases to the oil separating element along the shaft, and a first gas outlet for discharging the at least partially oil separated gases. The system further comprises a filter element. The filter element comprises a second gas inlet, a second gas outlet, and a filter arranged between the second gas inlet and the second gas outlet. The first gas inlet is configured to be connected to a crankcase blow-by crankcase outlet of the ICE. The first gas outlet is connected to the second gas inlet.

The present disclosure is based on the concept of using a disc stack separator connected to a filter element to increase the separation of oil particles from crankcase blow-by gases. A disc stack separator provides a filtration rate of substantially 100% for particles having a size above 0.6 μm. The filtration rate may further be dependent on a flow rate of the crankcase blow-by gases, such that a filtration rate of substantially of 100% may be achieved for particles having particles having a size below 0.6 μm, such as below 0.5 μm, 0.4 μm or 0.3 μm, when the flow rate is reduced. Further, a disc stack separator may not require regular service. However, the filtration rate of a disc stack separator may decrease with regards to particles having a size less than, for example, 0.6 μm. On the other hand, a filter element has a filtration rate of substantially 100%, regardless of the size of the particles. However, a filter element inherently has a low loading capacity, a short lifetime and requires regular service or replacement. By first using a disc stack separator to separate oil particles having a size above 0.6 μm before the crankcase blow-by gases are sent to the filter element, the load for the filter element is greatly reduced. In other words, the amount of particles which has to be separated by the filter element, in comparison to only using a filter element, is greatly reduced. Thereby, the lifetime of the filter element is extended. The lifetime of the filter element may be increased at least 25 times. Further, the loading capacity of the filter element is increased. In other words, the filter element may be used for a longer time before a maximum capacity of the filter element is reached. Alternatively, the size of the filter of the element may be decreased without decreasing the required service interval. Thus, combining a disc stack separator and a filter element achieves a synergistic effect as the advantages of both technologies are present.

By the term "oil particles" it is meant, for example, oil droplets and/or oil mist. The disc stack separator may comprise rotating means configured for rotating the shaft of the disc stack separator. The rotating means may comprise a turbine wheel, or an electric motor. The turbine wheel may be configured to be operated, for example, with oil, i.e. being oil-powered, via a belt, or a gear. The disc stack separator may be attached to an engine block of the ICE. The disc stack separator may be attached to, or integrated with a part of the engine block of the ICE, such as, for example, a cam cover. However, the disc stack separator may be a stand-alone component, i.e. not integrated with the engine block of the ICE. The first gas inlet may be connected to the crankcase blow-by outlet of the ICE, or the engine block, via an adapter conduit. The adapter conduit may be customizable, such that the system may be connected to many different kinds of ICEs. The system may be configured to release the filtered crankcase blow-by gases from the second gas outlet to an external space, such as the atmosphere.

The filter may be composed of a layer of arranged fibers, wherein the fibers may comprise polypropylene and/or fiberglass. The filter may be an Efficient Particulate Air, EPA, filter, high-efficiency particulate air, HEPA, filter or an Ultra Low Particulate Air, ULPA, filter. Thereby the filtration capacity of the system may be increased. An EPA filter may have a retention rate between 85% to 99%. A HEPA filter may have a retention rate between 99.95% to 99.999%. An ULPA filter may have a retention rate which is higher than a HEPA filter. A higher filter retention rate may lead to the filter reaching a maximum load capacity quicker. Thus, using disc stack separator may allow for using filters having a higher retention rate, thereby increasing the retention of particles.

One way of preventing crankcase blow-by gases from being released into the atmosphere has been by sending the crankcase blow-by gases back to a combustion chamber of the ICE. The second gas outlet may be configured to be connected to an intake manifold or an intake side of the ICE. Thus, the crankcase blow-by gases which has been cleaned by the system may be fed back to the ICE via the intake manifold. The intake manifold may be connected to combustion chambers of the ICE. Oil particles being present in the gas fed to the ICE may reduce the efficiency of the ICE and/or increase the risk of a malfunction of the ICE. Thus, the present system may improve the performance of the ICE.

The filter element may further comprise a pressure regulation valve. The first gas outlet may be connected to the second gas inlet via the pressure regulation valve. Alternatively, the second gas outlet may be connected to the pressure regulation valve. The pressure regulation valve may comprise a diaphragm. The pressure regulation valve may further comprise a spring configured to pre-load the pressure regulation valve. The pressure regulation valve may allow for a more efficient feeding of cleaned crankcase blow-by gases to the intake manifold, or intake side, of the ICE.

The filter element may comprise a positive crankcase ventilation, PCV, valve, wherein the first gas outlet may be conned to second gas inlet via the PCV valve. The PCV valve may provide an alternative way to allow for a more efficient feeding of cleaned crankcase blow-by gases to the intake manifold, or in intake side, of the ICE.

The pressure regulation valve may be arranged within the housing. Correspondingly, the PCV valve may be arranged within the housing. Thereby providing a more robust and compact system, which may increase the durability of the system. The housing may comprise a detachable portion, a lid, or a latch, which may allow a user to access the pressure regulation valve. The system may further comprise one or more bypass valves. The one or more bypass valve(s) may be configured to, for example, allow gas to be released if a pressure difference between two sides of a bypass valve exceeds a threshold, or if a gas flow level of the system is exceeded.

The first gas outlet may be arranged through a wall of the housing. For example, the first gas outlet may be connected to an opening in a wall of the housing. Thereby, the second gas inlet of the filter element may be securely connected to the housing and thereby to the first gas outlet. The pressure regulation valve may comprise an outlet, wherein the outlet may be arranged through a wall of the housing, or be connected to an opening in a wall of the housing, and thereby connectable to the first gas outlet.

The chamber may be formed by the housing. In other words, the housing may comprise the chamber. The chamber being formed, or comprised, by the housing may be understood as, for example, internal walls of the housing forming the chamber.

The housing may further comprise an oil reservoir. By the term "oil reservoir" is further meant, for example, oil chamber, or drive oil chamber. The disc stack separator may be configured to discharge oil separated from the crankcase blow-by gases into the oil reservoir. Thus, the disc stack separator may be configured to collect the separated oil into the oil reservoir. The oil reservoir may be connected to the chamber of the disc stack separator. The system may be configured to deliver oil from the oil reservoir to the ICE.

During operation of the ICE and the crankcase ventilation system, the filter element may be continuously filtering the crankcase blow-by gases and thereby retain oil particles. When the amount of oil particles retained by the filter reaches a certain level, the filter needs service or replacement. The arrangement of the filter element according to the present disclosure provides a more accessible filter element, and thereby provides easier replacement of a filter of the filter element. The present crankcase ventilation system may further be configured to collect oil, or oil particles, from the filter element. Further, the system may comprise an oil drain channel configured to deliver the collected oil to the oil reservoir. The filter element may be configured to allow retained oil to drain, or flow, into the oil drain channel. The drainage of flow may be higher when the ICE is not operating. Further, the force of gravity may assist the drainage of oil from the filter element. Thus, the crankcase ventilation system allows for drainage of the filter element, especially when the ICE is not operating. Thereby, the time before a filter needs to be serviced or replaced may be increased.

The first gas outlet may be connected to the second gas inlet via a gas conduit, thereby providing the ability of arranging the housing and the filter housing at a distance from each other. The gas conduit may further be configured as, for example, a pipe, a tube, such as a connecting tube, or a channel. A system comprising a pressure regulation valve, or a PCV valve, for which the first gas outlet is connected to the second gas inlet via the pressure regulation valve, or the PCV valve, may comprise at least one gas conduit which may be arranged between the first gas outlet and the pressure regulation valve, or the PCV valve, and/or between the pressure regulation valve, or the PCV valve, and the second gas outlet.

The filter element may comprise a filter housing. The filter may be arranged within the filter housing. Thus, the system may comprise a housing, in which the disc stack separator is arranged, and a filter housing, in which the filter element is arranged. A system having two separate housings allows for an increased flexibility when connecting the system to an ICE. As there is limited amount of space in a vehicle, it may be hard to fit a crankcase ventilation system into such a space. Further, the temperatures in some of the spaces around an ICE may not be suitable for all components of a crankcase ventilation system. Thus, by providing a system split into two housings the system can be placed more optimally with regards to fitting inside the space and/or with regards to temperatures inside the space.

The filter element may comprise a filter chamber, in which the filter may be arranged within the filter chamber. The second inlet may be arranged through a first wall of the filter chamber. The second outlet may be arranged through a second wall of the filter chamber. The second wall may be the same wall as the first wall, or a different wall than the first wall. Therefore, the second inlet and the second outlet may be arranged through the same wall, or through different walls. The filter chamber may be comprised by the housing. Thus, the housing, which may comprise a plurality of parts which may be welded and/or fastened together, may comprise the filter chamber of the filter element and the chamber of the disc stack separator. At least one side of the filter chamber may comprise a shape which is adapted to fit to a side of the chamber of the disc stack operator. A housing comprising the chamber and the filter chamber may be understood as an integrated solution, in which both of the disc stack separator and the filter element are realized within the same arrangement, or component. Thus, a more compact system may be provided. The arrangement comprising both of the technologies further may provide an easier installation of the system as fewer components need to be attached to an ICE.

The filter chamber may comprise a detachable cover. The filter chamber may comprise six sides. The detachable cover may form one of the six sides. Further, the detachable cover may form one of the six sides and portions of sides neighboring the side formed by the detachable cover. For example, The detachable cover may form a first side, and portions of the four sides neighboring the first side. The detachable cover may be attached to the rest of the filter chamber by fastening means, such as, for example, screws or bolts. Further, the detachable cover may be attached to the rest of the filter chamber via a hinge. The detachable cover may allow for a user to access the filter within the filter chamber, thereby providing easier replacement of a filter.

The second outlet may be arranged through the detachable cover. Alternatively, the second outlet may be arranged through a side, or a wall of the filter chamber.

At least a portion of the chamber of the disc stack separator may be abutting at least a portion of the filter chamber. The at least a portion of the filter chamber may comprise at least a portion of one or more sides of the chamber, and the at least a portion of the filter chamber may comprise at least a portion of one or more sides of the filter chamber. Thus, a more compact system may be provided.

BRIEF DESCRIPTION OF THE DRAWINGS

This and other aspects of the present disclosure will now be described in more detail, with reference to the appended drawings showing embodiment(s) of the disclosure.

DETAILED DESCRIPTION

Figure 1:
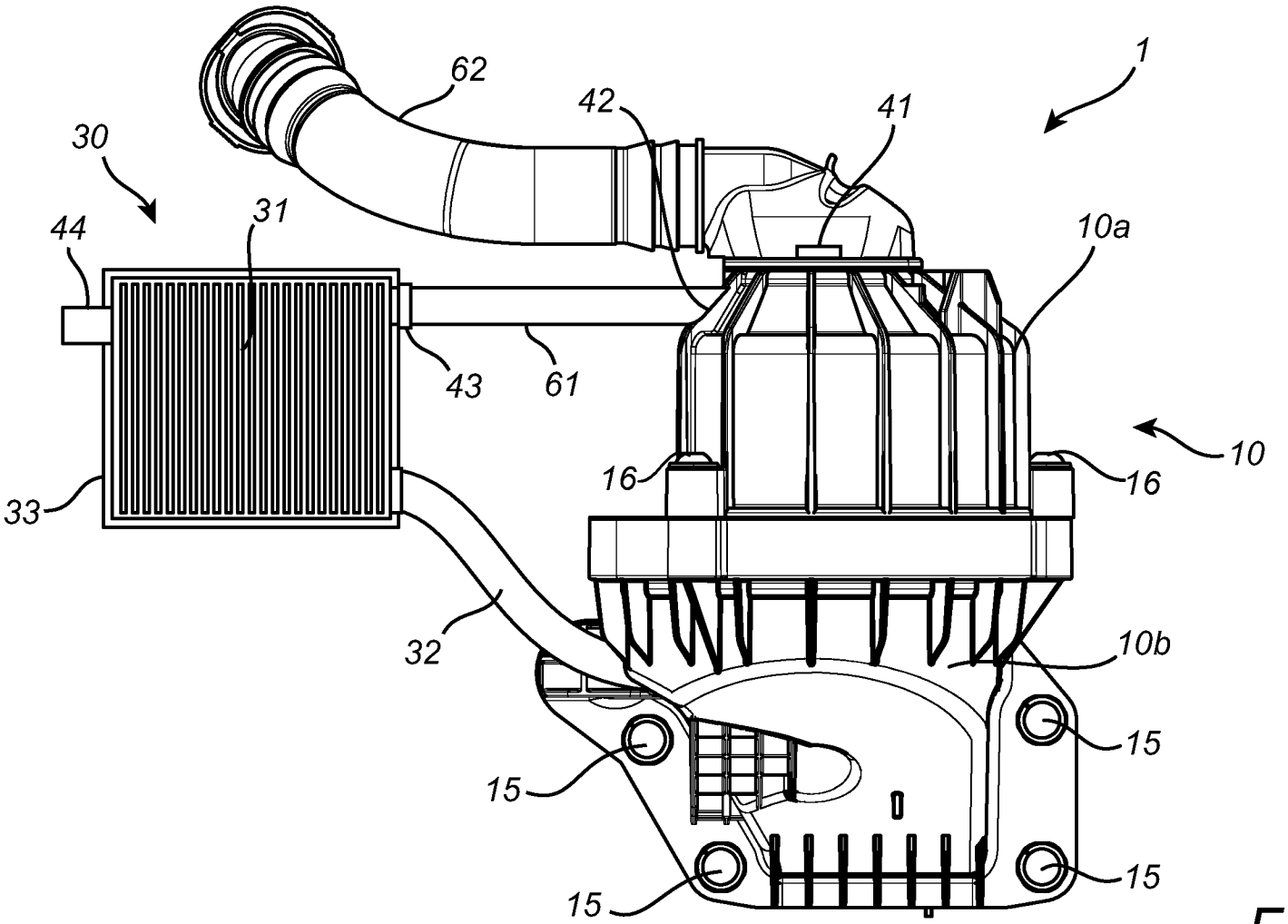
FIG. 1 schematically shows a crankcase ventilation system according to an exemplifying embodiment of the present disclosure.

FIG. 1 schematically shows a crankcase ventilation system 1 according to an exemplifying embodiment of the present disclosure.

The system 1 comprises a housing 10. The housing 10 comprises an upper portion 10*a* and a lower portion 10*b*. The upper portion 10*a* has a generally cylindrical shape comprising a top and a bottom. The lower portion 10*b* also has a generally cylindrical shape comprising a bottom and a top. The upper and lower portions 10*a*, 10*b* are connected and sealed together by means of fastening means 16, which are illustrated in FIG. 1 as, but not limited to, screw nuts 16. More specifically, the bottom of the upper portion 10*a* is connected to the top of the lower portion 10*b*. The housing 10 further comprises attachment means 15 configured for attaching the housing 10 to an internal combustion engine, ICE. The attachment means 15 are illustrated in FIG. 1 as, but not limited to, threaded holes adapted to receive screw nuts. The position of the attachment means 15 on the housing 10 may be adapted to fit to a specific ICE.

The system 1 further comprises a disc stack separator (not shown; see FIG. 2 or FIG. 4) configured for, at least partially, separating oil particles from crankcase blow-by gases of the ICE, and is arranged within the housing 10. The disc stack separator comprises a first gas inlet 41 configured to be connected to a crankcase blow-by outlet of the ICE and for supplying the crankcase blow-by gases from the ICE to the disc stack separator. The first gas inlet 41 is arranged through the top of the upper portion 10*a* of the housing 10. The disc stack separator further comprises a first gas outlet 42 for discharging the, at least partially, oil-separated gases from the disc stack separator. The first gas outlet 42 is arranged through a circumferential side of the upper portion 10*a* of the housing 10. In other words, the first gas outlet 42 is arranged through a wall of the housing 10.

Figure 2:
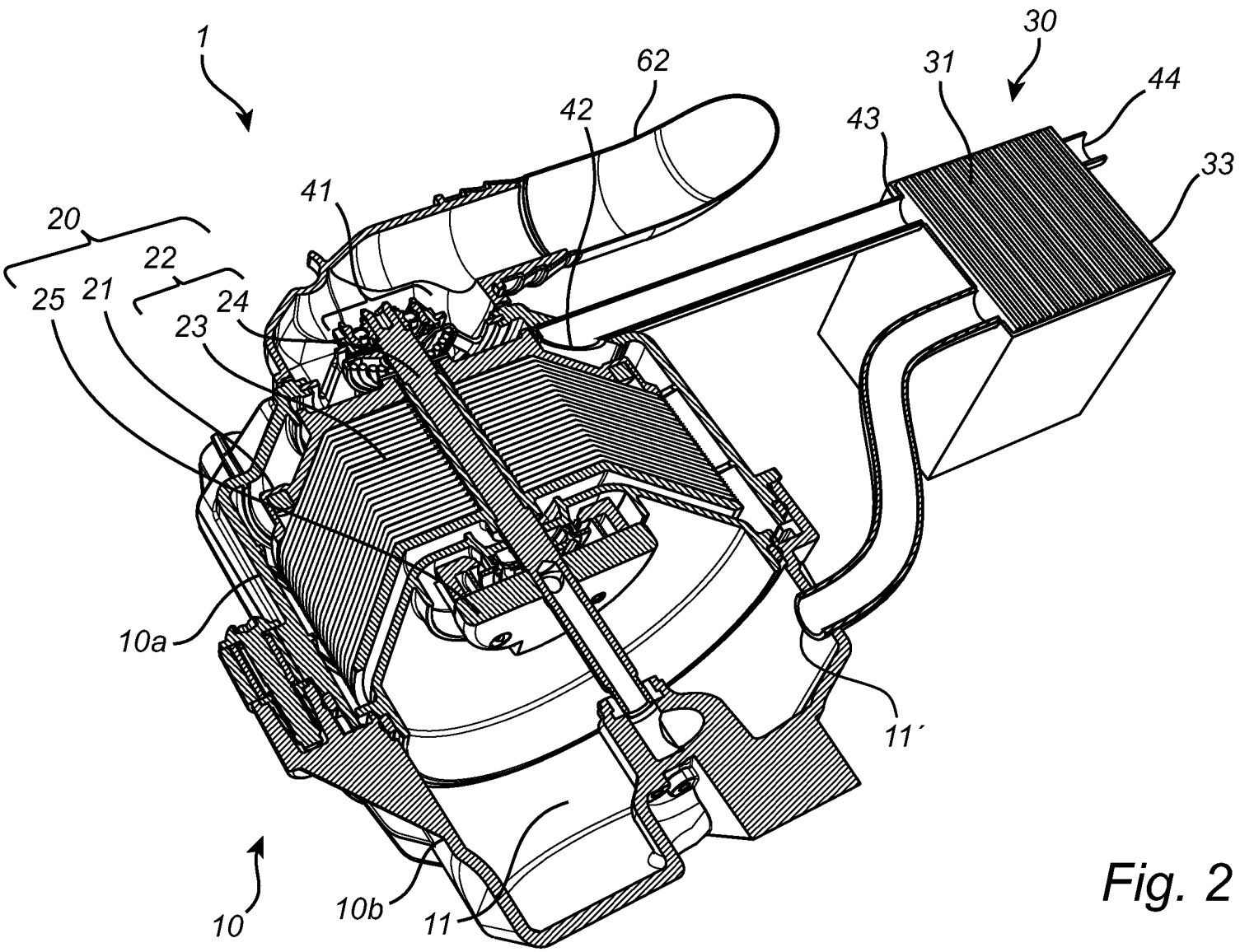
FIG. 2 schematically shows a cross-section of a crankcase ventilation system according to an exemplifying embodiment of the present disclosure.

The housing 10 may further comprise an oil reservoir (not shown; see FIG. 2). The disc stack separator may be configured to discharge oil separated from the crankcase blow-by gases into the oil reservoir. The oil reservoir may be arranged within the lower portion 10*b* of the housing 10.

The system 1 further comprises a filter element 30. The filter element 30 comprises a filter housing 33 and a filter 31 arranged within the filter housing 33. The filter element 30 further comprises a gas inlet 43 and a gas outlet 44, which are arranged through opposite sides of the filter housing 33. The filter 31 is arranged between the gas inlet 43 and the gas outlet 44. Further, the filter 31 is connected between the gas inlet 43 and the gas outlet 44 such that gas inlet 43 and the gas outlet 44 are fluidly connected via the filter 31. In other words, gases have to pass through the filter 31 in order to travel from the gas inlet 43 to the gas outlet 44.

The first gas outlet 42 of the disc stack separator 20 is connected to the second gas inlet 43 of the filter element 30. In FIG. 1, the system 1 further comprises a gas conduit 61 which connects the first gas outlet 42 and the second gas inlet 43, thereby allowing the filter element 30 to be arranged at a distance from the housing 10 and the disc stack operator 20. It is be understood that the present disclosure is not limited to the exemplary embodiment as shown in FIG. 1. For example, the filter element 30 may be arranged at, or attached to, the housing 10. In such an exemplary embodiment, the first gas outlet 42 and the second gas inlet 43 may be directly connected to each other. However, the system 1 may comprise a filter element 30 arranged at, or attached to, the housing 10 and comprise a gas conduit 61 which connects the first gas outlet 42 and the second gas inlet 43.

The system 1 may further comprise an oil drain channel 32 as shown in FIG. 1. The oil drain channel 32 may be configured to deliver oil that has been retained, filtered, or captured, by the filter 31 to the housing 10. More specifically, the drain channel 32 may be configured to deliver oil that has been retained, filtered, or captured, by the filter 31 to an oil reservoir (not shown; see FIG. 2 or FIG. 4) of the housing 10.

The second gas outlet 44 may be configured to be connected to an intake manifold (not shown) of the ICE. Thereby, the crankcase blow-by gases which have been filtered by the system 1 may be fed back into the ICE. The second gas outlet 44 may be connected to an intake manifold in a number of different ways. For example, the system 1 may comprise a secondary gas conduit configured for connecting the second gas outlet 44 to the intake manifold. In another example, the filter element 30 may be arranged at the intake manifold such that the second gas outlet 44 is connected directly to the intake manifold.

FIG. 2 schematically shows a cross-sectional view of a crankcase ventilation system 1 according to an exemplifying embodiment of the present disclosure. It should be noted that FIG. 2 comprises features, elements and/or functions as shown in FIG. 1 and described in the associated text. Hence, it is also referred to FIG. 1 and the description relating thereto for an increased understanding.

The shown cross-section of the crankcase ventilation system 1 is made along a longitudinal axis of a disc stack separator 20 of the system 1. Thereby, an inside of the disc stack separator 20 is shown. The system 1 comprises a housing 10 in which the disc stack separator 20 is arranged within. The housing 10 comprises an upper portion 10*a* and a lower portion 10*b*. The disc stack separator 20 comprises a chamber 21 and a rotor 22. The chamber 21 is at least in part defined by inner walls of the upper portion 10*a* of the housing 10. In other words, the chamber 21 is formed by the housing 10. The rotor 22 comprises an oil separating element 23 and a shaft 24. The oil separating element 23 is arranged within the chamber 21. The shaft 24 is arranged from a top of the upper portion 10*a* of the housing 10 to a bottom of the lower portion 10*b* of the housing 10, and is thereby arranged through the chamber 21. The oil separating element 23 is rotatably mounted on the shaft 24. Further, the oil separating element 23 is arranged within the chamber 21 and is spaced from walls of the chamber 21 such that there is space between walls of the chamber 21 and the oil separating element 23.

The disc stack separator 20 further comprises a rotating means 25. The rotating means 25 is illustrated in FIG. 2 as a turbine wheel mounted to the shaft 24 and arranged in the lower portion 10*b* of the housing 10. However, the rotating means 25 is not limited to the exemplary embodiment as shown in FIG. 2, and may be, for example, configured as an electric motor. The rotating means 25 is configured to rotate the shaft 24, thereby rotating the oil separating element 23. In FIG. 2, the rotating means 25 is configured to rotate with the shaft 24. However, the present disclosure is not limited to a rotating means 25 configured to rotate with the shaft 24, and may comprise a fixed nozzle configured to rotate the rotating means 25, thereby rotating the shaft 24.

The housing 10 as illustrated in FIG. 2 may be understood to comprise an oil reservoir 11. The oil reservoir 11 may be defined by a space within the lower portion 10*b* of the housing 10. The housing 10 may comprise an oil channel between the upper portion 10*a* of the housing 10 and the lower portion 10*b* of the housing. Phrased differently, the system 1 may comprise an oil channel between the chamber 21 and the oil reservoir 11. The oil channel may be configured to deliver oil which has been separated by the disc stack separator 20 from the crankcase blow-by gases into the oil reservoir 11. In other words, the disc stack separator 20 may be configured to discharge oil separated from the crankcase blow-by gases into the oil reservoir 11. A rotating means 25 comprising a turbine wheel, as indicated in FIG. 2 may be powered by oil, which may be collected in the oil reservoir 11 once it has jetted out from the turbine wheel.

The system 1 shown in FIG. 2 further comprises a filter element 30. A difference between the system 1 shown in FIG. 2 and the exemplary embodiment as shown in FIG. 1 is that the oil reservoir 11 comprises an opening 11' to which a drain channel 32 of the filter element 30 is connected, thereby allowing for the system 1 to deliver oil from the filter element 30 to the oil reservoir 11.

Figure 3:
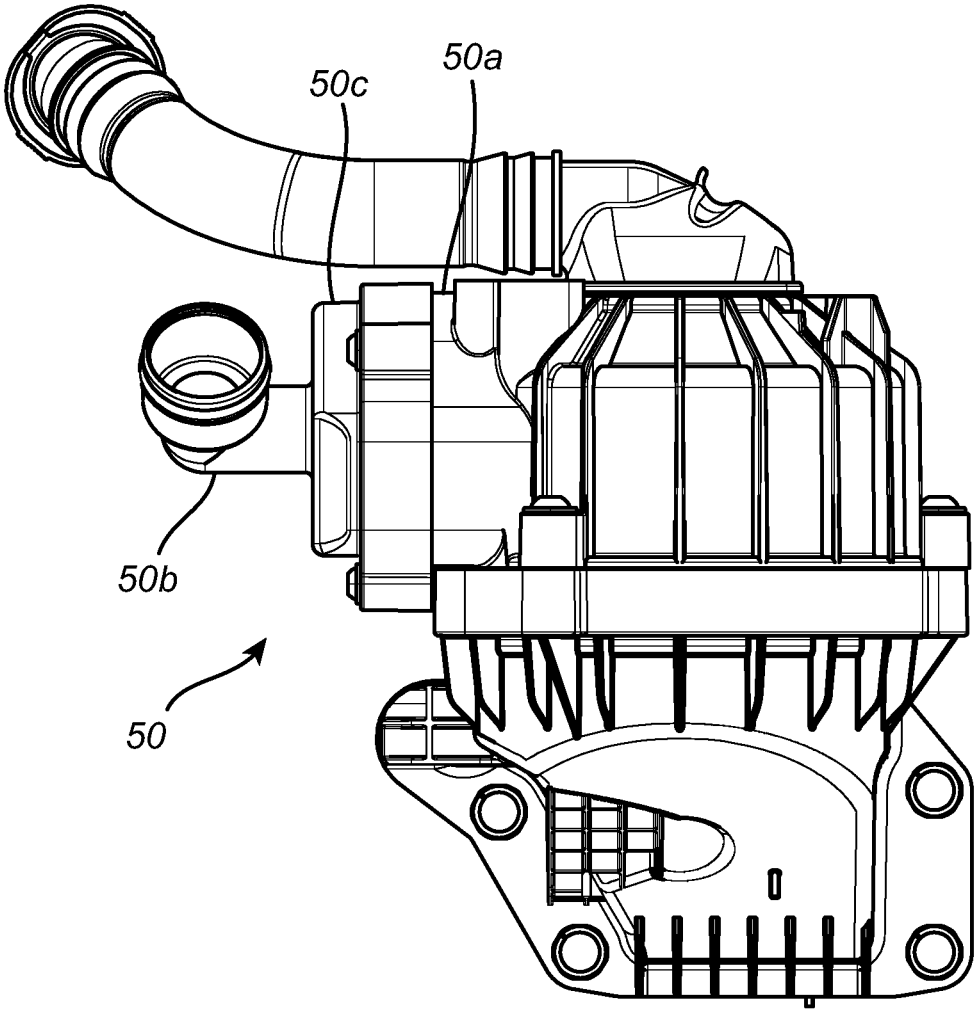
FIG. 3 schematically shows a crankcase ventilation system according to an exemplifying embodiment of the present disclosure.

FIG. 3 schematically shows a crankcase ventilation system 1 according to an exemplifying embodiment of the present disclosure. It should be noted that FIG. 3 comprises features, elements and/or functions as shown in FIGS. 1 and 2 and described in the associated texts. Therefore, the following will describe the differences between the system 1 shown in FIG. 3 and the exemplary embodiments shown in FIGS. 1 and 2 and described in the associated texts. Hence, it is also referred to FIGS. 1 and 2 and the descriptions relating thereto for an increased understanding.

A difference between the system 1 shown in FIG. 3 and the exemplary embodiment as shown in FIG. 1 is that the system 1 shown in FIG. 3 comprises a pressure regulation valve 50.

The pressure regulation valve 50 is arranged within the housing 10. More specifically, the housing 10 shown in FIG. 3 comprises an auxiliary portion 50*a* formed on the upper portion 10*a* of the housing 10, in which the pressure regulation valve 50 is arranged. The auxiliary portion 50*a* may comprise a detachable portion 50*c* which, when opened, may allow a user to access to the pressure regulation valve 50. However, the present disclosure is not limited to the auxiliary portion 50*a* being formed on the housing 10, and may, for example, be arranged at a distance from the housing 10. In such an example, the first outlet 42 may be connected to the pressure regulation valve 50 via a conduit or channel. Thus, the auxiliary portion 50*a* may be understood as being comprised by the pressure regulation valve 50.

The pressure regulation valve 50 is connected to the first gas outlet (not shown; see e.g. FIG. 1, 2 or 4) of the disc stack separator 20, which may be arranged through a side of the upper portion 10*a* of the housing 10. In FIG. 3 the pressure regulation valve 50 is shown to be connected to the first gas outlet by the auxiliary portion 50*a* being formed over the first gas outlet.

The system 1 may further comprise an auxiliary conduit 50*b* as shown in FIG. 3. The auxiliary conduit 50*b* may be connected to the auxiliary portion 50*a*, in which the pressure regulation valve 50 is arranged, via the detachable portion 50*c*, or directly. The auxiliary conduit 50*b* may be configured for being connected to the second gas inlet 43 of the filter element 30. Thus, the first gas outlet of the disc stack separator 20 may be connected to the second gas inlet 43 of the filter element 30 via the pressure regulation valve 50.

Figure 4:
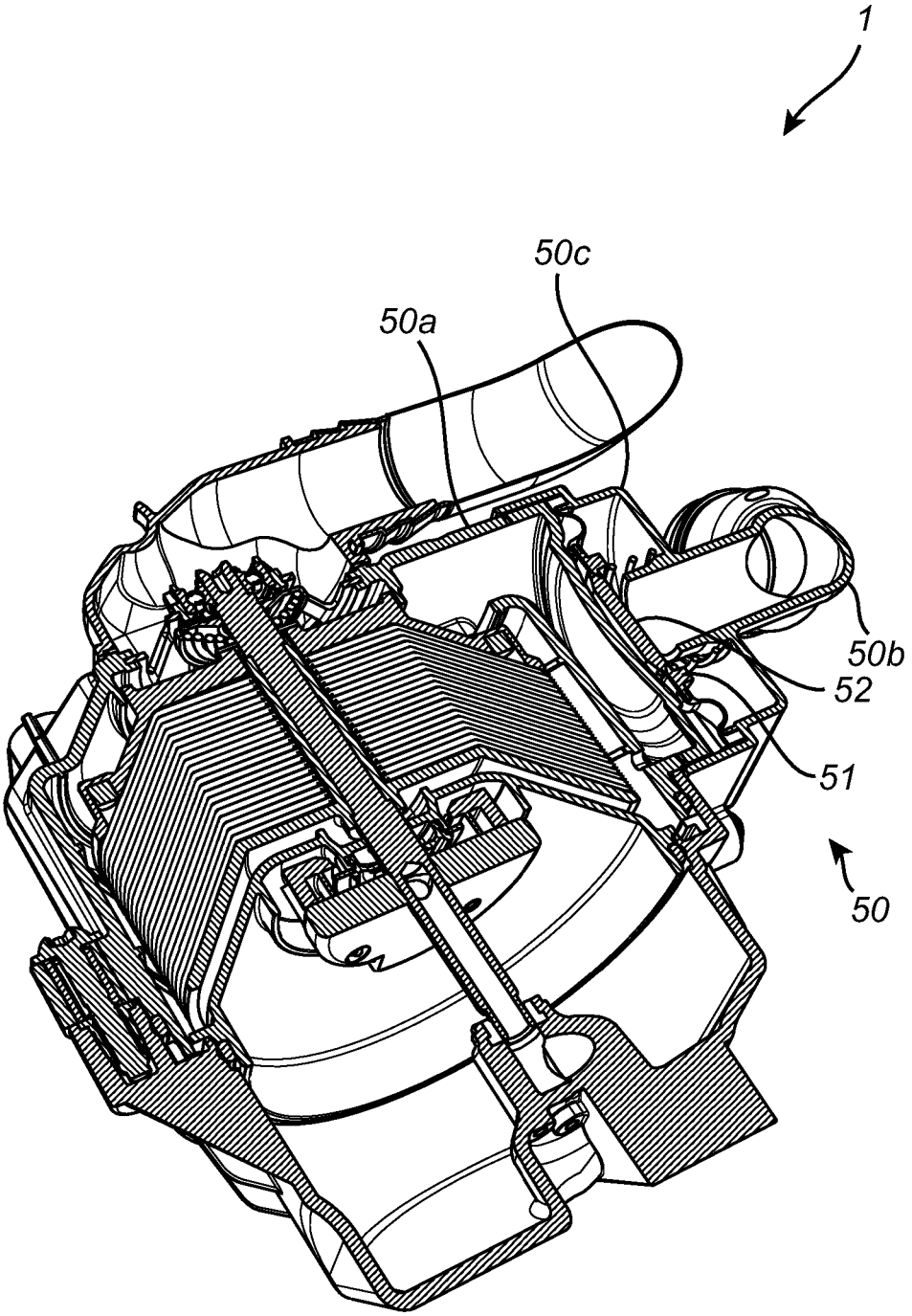
FIG. 4 schematically shows a cross-section of a crankcase ventilation system according to an exemplifying embodiment of the present disclosure.

FIG. 4 schematically shows a cross-section of a crankcase ventilation system 1 according to an exemplifying embodiment of the present disclosure. It should be noted that FIG. 4 comprises features, elements and/or functions as shown in FIGS. 1 to 3 and described in the associated texts. Therefore, the following will describe the differences between the system 1 shown in FIG. 4 and the exemplary embodiments shown in FIGS. 1 to 3 and described in the associated texts. Hence, it is also referred to FIGS. 1 to 3 and the descriptions relating thereto for an increased understanding.

A difference between the system 1 shown in FIG. 4 and the exemplary embodiment as shown in FIG. 2 is that the system 1 shown in FIG. 4 comprises a pressure regulation valve 50 as shown in FIG. 3 and described in the associated text.

The pressure regulation valve 50 shown in FIG. 4 comprises a diaphragm 51 and a spring 52. The diaphragm 51 and the spring 52 are arranged in the auxiliary portion 50*a* of the housing 10. The diaphragm 51 and the spring 52 are arranged between the auxiliary portion 50*a* and the detachable portion 50*c*.

Figure 5:
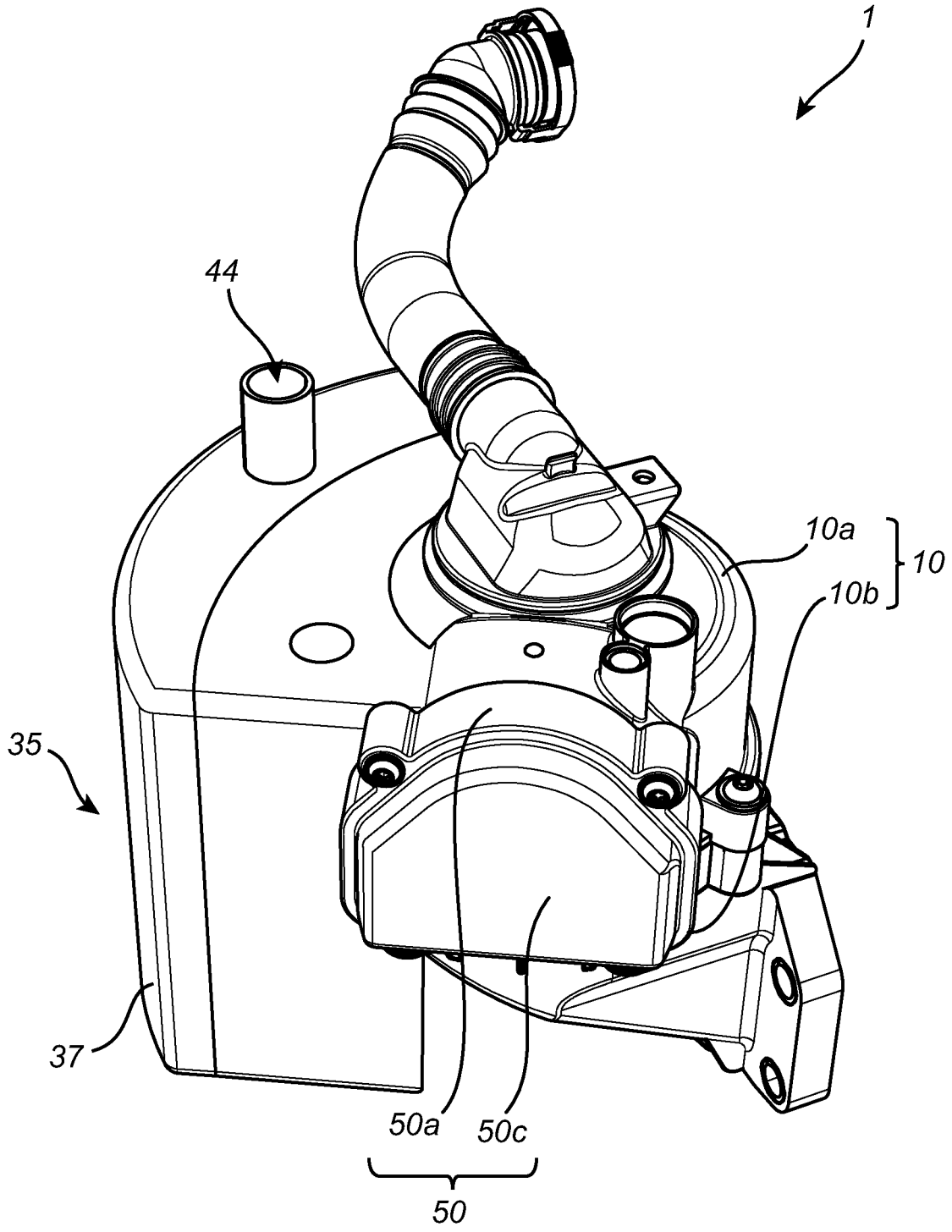
FIG. 5 schematically shows a crankcase ventilation according to an exemplifying embodiment of the present disclosure.

FIG. 5 schematically shows a crankcase ventilation system 1 according to an exemplifying embodiment of the present disclosure. It should be noted that FIG. 5 comprises features, elements and/or functions as shown in FIGS. 1 to 4 and described in the associated texts. Therefore, the following will describe the differences between the system 1 shown in FIG. 5 and the exemplary embodiment shown in FIGS. 1 to 4 and described in the associated texts. Hence, it is also referred to FIGS. 1 to 4 and the descriptions relating thereto for an increased understanding.

A difference between the system 1 shown in FIG. 5 and the system shown in FIG. 3 and described in the associated text is that the system 1 shown in FIG. 5 further comprises a filter chamber 35, which forms a part of the housing 10 of the system 1. In other words, the housing 10 comprises the filter chamber 35. The filter chamber 35 comprises a filter (not shown) which is arranged between a second inlet (not shown) and a second outlet 44.

The filter chamber 35 has six sides, out of which three are shown in FIG. 5. The second outlet 44 is arranged through a top side, of the six sides, of the filter chamber 35. At least a portion of a side of the filter chamber 35, hereinafter referenced to as the inner side of the filter chamber 35, is arranged against an upper portion 10*a* and a lower portion 10*b* of the housing 10. The second inlet may be arranged through the at least a portion of the inner side. The upper portion 10*a* and the lower portion 10*b* have generally cylindrical shapes. The at least a portion of the inner side has a shape adapted to be arranged flush against the upper portion 10*a* and the lower portion 10*b*. Thus, at least a portion of the disc stack separator is abutting at least a portion of the filter chamber 35. The shape of the inner side may be understood as being curved. A side of the filter chamber 35 which is opposite the inner side, hereinafter referenced to as the outer side of the filter chamber 35, has a similarly curved shape as the inner side. The remaining sides of the filter chamber 35 have substantially flat shapes, such that the filter chamber 35 has a shape in general accordance with a segment of a flat ring. It is to be understood that the present disclosure is not limited to a filter chamber 35 having a shape as shown in FIG. 5. For example, the filter chamber 35 may have any number of sides, such as two, three, four, or more. Further, the shapes of the sides of the filter chamber 35 may be, substantially, any geometrical shape.

The filter chamber 35 comprises a detachable cover 37. The detachable cover 37 is configured to be detached in order to allow access for a user to the filter arranged within the filter chamber 35. The detachable cover 37 forms the outer side of the filter chamber 35 and portions of the four sides neighboring the outer side. It is to be understood that the present disclosure is not limited to comprising a detachable cover 37 as shown in FIG. 5. For example, the detachable cover 37 may form a portion, or the whole, of at least any of the outer side and/or one or more of the sides of the filter chamber 35 neighboring the outer side.

Another difference between the system 1 shown in FIG. 5 and the system shown in FIG. 3 and described in the associated text is that the system 1 shown in FIG. 5 further comprises a pressure regulation valve 50, but does not comprise an auxiliary conduit as shown in FIG. 3 which may connect the pressure regulation valve 50 to the second inlet. The system 1 shown in FIG. 5 comprises an auxiliary portion 50*a* formed on the upper portion 10*a* of the housing 10, in which the pressure regulation valve 50 is arranged. The system 1 further comprises a detachable portion 50*c* which, when opened, may allow a user to access to the pressure regulation valve 50. Instead of an auxiliary conduit, as shown in FIG. 3, the pressure regulation valve 50 comprises a conduit (not shown) which is arranged within the housing 10 and which is connected to the second inlet, thereby providing a more compact system 1.

The second outlet 44 is shown to be arranged through the detachable cover 37. However, the second outlet 44 may be arranged on any of the sides of the filter chamber 35.

It is to be understood that the present disclosure is not limited to the embodiment as shown in FIG. 5, and that the system 1 may, alternatively, comprise a pressure regulation valve 50 similar to the one shown in FIG. 3, and that an auxiliary conduit may be arranged outside of the housing 10 from the auxiliary portion 50*a* to a second inlet arranged through a side of the filter chamber 35. In another example, the system 1 does not comprise a pressure regulation valve 50 and the first outlet of the disc stack separator of the system 1 is connected to the second inlet, wherein said connection may be made via an auxiliary conduit arranged outside of the housing 10, via a conduit arranged within the housing 10, or by arrangement of the first outlet and the second inlet with regards to each other such that no conduit is necessary. The person skilled in the art realizes that the present disclosure by no means is limited to the preferred embodiments described above. On the contrary, many modifications and variations are possible within the scope of the appended claims.

The invention claimed is:

1. A crankcase ventilation system for separating oil particles from crankcase blow-by gases of an internal combustion engine, ICE, comprising a housing;

a disc stack separator arranged within the housing comprising a chamber;

a rotor comprising an oil separating element arranged within the chamber and spaced from one or more walls of the chamber; and a shaft configured to rotatably mount the oil separating element;

a first gas inlet for supplying the crankcase blow-by gases to the oil separating element along the shaft; and a first gas outlet for discharging the at least partially oil-separated gases;

a filter element comprising a second gas inlet, a second gas outlet, and a filter arranged between the second gas inlet and the second gas outlet, wherein the filter is composed of a layer of arranged fibers; and wherein the first gas inlet is configured to be connected to a crankcase blow-by outlet of the ICE, wherein the first gas outlet is connected to the second gas inlet, and wherein the filter element is not connected to the shaft.

2. The system according to claim 1, wherein the filter is an Efficient Particulate Air, EPA, filter, high-efficiency particulate air, HEPA, filter or an Ultra Low Particulate Air, ULPA, filter.

3. The system according to claim 1, wherein the second gas outlet is configured to be connected to an intake manifold of the ICE.

4. The system according to claim 3, wherein the filter element further comprises a pressure regulation valve, and wherein the pressure regulation valve is connected between the first gas outlet and the second gas inlet, or connected to the second gas outlet.

5. The system according to claim 4, wherein the pressure regulation valve is arranged within the housing.

6. The system according to claim 1, wherein the first gas outlet is arranged through a wall of the housing.

7. The system according to claim 1, wherein the chamber is formed by the housing.

8. The system according to claim 1, wherein the housing further comprises an oil reservoir, and wherein the disc stack separator is configured to discharge oil separated from the crankcase blow-by gases into the oil reservoir.

9. The system according to claim 8, wherein the system further comprises an oil drain channel configured to deliver the oil from the filter element to the oil reservoir.

10. The system according to claim 1, wherein the first gas outlet is connected to the second gas inlet via a gas conduit.

11. The system according to claim 1, wherein the filter element comprises a filter housing, and wherein the filter is arranged within the filter housing.

12. The system according to claim 1, wherein the filter element comprises a filter chamber comprised by the housing, and wherein the filter is arranged within the filter chamber.

13. The system according to claim 12, wherein the filter chamber comprises a detachable cover.

14. The system according to claim 13, wherein the second outlet is arranged through the detachable cover.

15. The system according to claim 12, wherein at least a portion of the chamber of the disc stack separator is abutting at least a portion of the filter chamber.

* * * * *